United States Patent [19]

Johansson

[11] Patent Number: 4,852,187

[45] Date of Patent: Aug. 1, 1989

[54] PIECE OF MATERIAL FOR AN ARTICLE OF CLOTHING AND USE OF THE PIECE OF MATERIAL FOR PRODUCTION OF AN ARTICLE OF CLOTHING

[76] Inventor: Eva Johansson, Fridhemsvägen 11, S-183 65 Täby, Sweden

[21] Appl. No.: 216,621

[22] PCT Filed: Jul. 23, 1987

[86] PCT No.: PCT/SE87/00342

§ 371 Date: Jun. 29, 1988

§ 102(e) Date: Jun. 29, 1988

[87] PCT Pub. No.: WO88/00444

PCT Pub. Date: Jan. 28, 1988

[30] Foreign Application Priority Data

Jul. 24, 1986 [SE] Sweden ..... 8603197

[51] Int. Cl.[4] ..... A41B 1/08; A41B 9/06; A41D 1/02

[52] U.S. Cl. ..... 2/69; 2/74; 2/102; 2/108; 2/114; 2/113; 2/243 B

[58] Field of Search ..... 2/114, 115, 113, 106, 2/108, 111, 74, 75, 69, 69.5, 243 B, 102, DIG. 7

[56] References Cited

U.S. PATENT DOCUMENTS 3,911,499 10/1975 Beneuento et al. ..... 2/114
4,017,909 4/1977 Brandrifj ..... 2/DIG. 7
4,473,908 10/1984 Knecht ..... 2/243 B
4,587,671 5/1986 Rodriguez, Jr. et al. ..... 2/114 X
4,608,719 9/1986 Lunt ..... 2/74 X
4,649,573 3/1987 Yen ..... 2/108 X

*Primary Examiner*—H. Hampton Hunter

[57] ABSTRACT

Piece of material for an article of clothing (2) and use of the piece of material for production of a garment. The article of clothing is intended to cover at least the upper body and is provided with a front and a back which are finished with a lower edge, a shoulder section with a neck opening (13) and arms. The piece of material (1) has a first edge (3) which is intended to form the lower edge, a second edge (4, 5) opposite this, two side edges (6, 10 and 7, 11) opposite each other and two cuts (8, 9) which extend inwards from the side edges and which are finished at a distance from each other which corresponds approximately to the size across the chest. The piece of material is symmetrical about a center axis (16) on which the neck opening is located, the cuts (8, 9) form an angle, to the center axis (16), which, measured in the direction of the first edge (3), is less than 90°. The second edge is divided into two parts (4, 5) which each have an angle, to the center axis (16), which is less than the corresponding angle for the cuts (8, 9). The piece of material can be joined together by a single seam.

7 Claims, 6 Drawing Sheets

PIECE OF MATERIAL FOR AN ARTICLE OF CLOTHING AND USE OF THE PIECE OF MATERIAL FOR PRODUCTION OF AN ARTICLE OF CLOTHING

TECHNICAL FIELD

The present invention relates to a piece of material for an article of clothing or part of such and produced from a thin, web-like material, which article of clothing or part is intended to cover at least the upper body of a wearer and thus to be provided with a front and a back which are finished with a lower edge, and, opposite this, a shoulder section with a neck opening and, moreover, arms which are finished with wrists wherein the piece of material comprises a first edge, which is intended to form the said lower edge, a second edge opposite this, two side edges opposite each other which connect the two first-mentioned edges, and two cuts which extend inwards from the side edges and which are finished at a distance from each other which corresponds approximately to the size across the chest between the armpits for the body side for which the garment is intended, wherein the piece of material is essentially symmetrical about a centre axis along which a neck opening is to be located close to the second edge and use of the piece of material for production of an article of clothing or part of such, which article of clothing or part is intended to cover at least the upper body of a wearer and thus to be provided with a front and a back which are finished with a lower edge, and, opposite this, a shoulder section with a neck opening and, moreover arms which are finished with wrists, wherein the piece of material is produced from a thin, web-like material and comprises a first edge which is intended to form the said lower edge, a second edge opposite this, two side edges opposite each other which connect the two firstmentioned edges, and two cuts which extend inwards from the side edges and which are finished at a distance from each other which corresponds approximately to the size across the chest between the armpits for the body size for which the garment is intended, wherein the piece of material is essentially symmetrical about a centre axis along which a neck opening is to be located close to the second edge, with the said cuts forming an angle to the centre axis, which measured in the direction of the first edge, is less than 90°, and with the second edge divided into two parts each projecting from a side edge, which parts each have an angle, to the centre axis, which, measured in the direction of the first edge, is less than the corresponding angle for the cuts.

As is known, production of an article of clothing consists of cutting a piece of material in one or several parts out of a web-like material, which piece of material can be described as two-dimensional, and thereafter joining together certain edge lines of the piece of material to form the garment which is to enclose the wearer and which can be described as three-dimensional.

With certain use forms of garments, economy of production is of first importance, whereas factors such as fit and a certain decorative appearance of the garment are dispensed with. Typical of these are protective clothes intended to be used once or a few times. Such a garment is largely justified only if it can be manufactured at a cost so low that the replacement cost is lower than the cost for washing a more permanent garment and returning it to usable condition after occasions of use. Examples of articles of clothing which are of value if they can be produced in a one-use form are surgeons' gowns which it is desired should be sterile on use, a requirement which is difficult to satisfy with garments which are to be washed.

PRIOR ART

To achieve production at as low a cost as possible, the problem of material has to be tackled (in this connection non-woven fibre fabric has proved to be an excellent material for use and at a relatively low cost) as well as the problems of cutting and sewing.

An example of how an attempt was made to produce an efficient cutting and sewing process emerges from U.S. Pat. No. 3,911,499; Benevento; Hinsch. A piece of material for a surgeon's gown is produced according to this specification in a single material-piece by means of a limited number of cut-lines. The sewing together of the piece of material requires essentially two arm seams and two seams for joining together the back section.

This known gown is relatively efficient in production (it should perhaps be noted that the laying-free of the arms requires two cut-lines, and thus two material-pieces are used up) but for its use it is not completely satisfactory. Firstly, the arm seams are on the underside of the arm, which is certainly common in many garments but which, in this connection, is a disadvantage. On the one hand fluid which, during an operation, often runs from the hands firstly reaches the arm seams where it collects and where it is easier for it to penetrate through the garment than if it were spread over a non-cut surface. The arm seam situated on the underside also easily catches on objects, which can be covered with fluid. Moreover, the fit is less good across the shoulder section with far too limited relative width for work which, for the most part, involves the arms being held out in front.

TECHNICAL PROBLEM

The object of the present invention is to produce a piece of material for an article of clothing, which is highly efficient to produce a virtue of the fact that it requires an absolute minimum of cut-lines, which can be straight, and results in a minimum of material loss.

Another object is to produce a piece of material or a finished article of clothing which is particularly well suited for surgical work because the arm seam is not placed on the underside of the arm and because an extra width is obtained in the shoulder section.

Yet another object of the invention is to produce a piece of material for an article of clothing which can be sewn together by means of a small number of seams.

SOLUTION

The said objects are achieved by means of a piece of material for an article of clothing according to the present invention, which is characterized in that two cuts extend inwards from the side edges and form an angle, to the centre axis, which, measured in the direction of the first edge, is less than 90°, and that the second edge is divided into two parts each projecting from a side edge, which parts each have an angle, to the centre axis, which, measured in the direction of the first edge, is less than the corresponding angle for the cuts.

DESCRIPTION OF THE FIGURES

In the following there is described, with reference to the attached drawings, an embodiment of the piece of material or article of clothing, with the latter in two variants. The embodiment in this connection primarily refers to a gown intended to be used as a one-use garment for surgical operations. Alternatively, however, a use as a jacket and also a design as a more permanent garment may be imagined, such as a design as an upper part together with a lower part, not described here, in, for example, an overall.

In the drawings

PREFERRED EMBODIMENT

Figure 1:
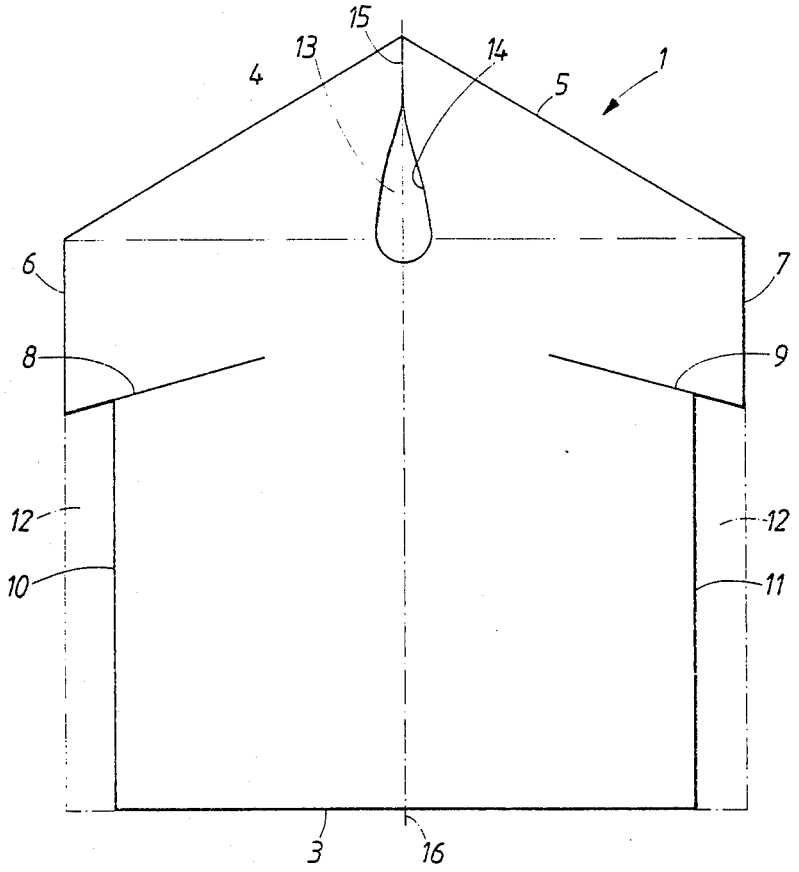
FIG. 1 shows the piece of material in a spread-out plane state.
Figure 4:
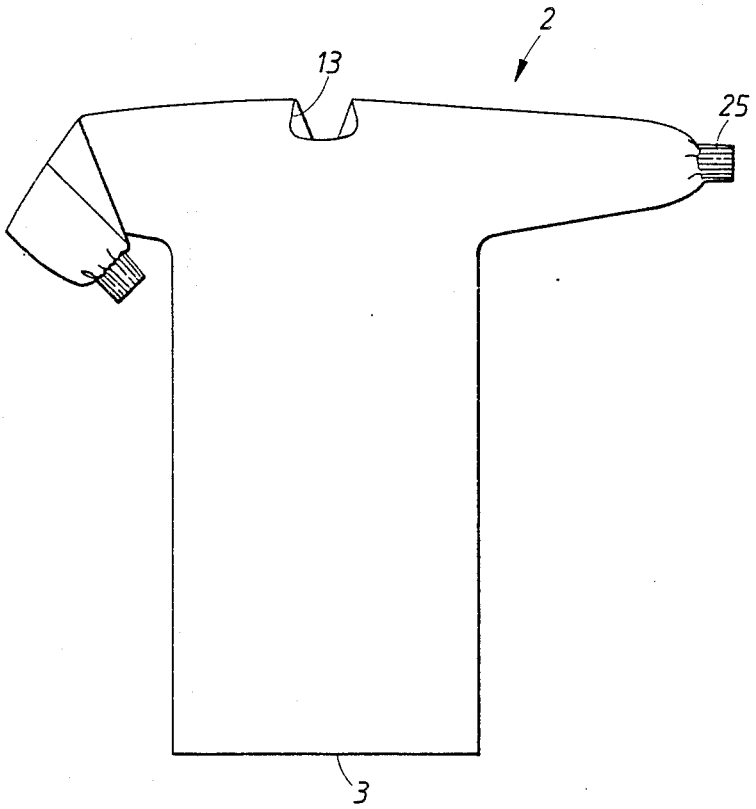
FIG. 4 shows, from the front, a gown produced from the piece of material and of the type which is used for surgeons' gowns and with a closure at the back.
Figure 5:
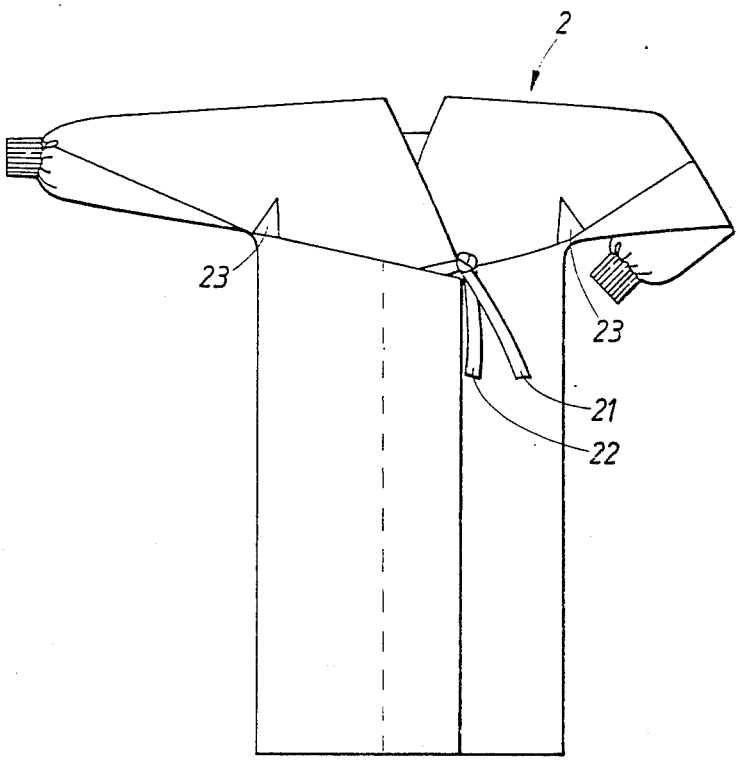
FIG. 5 shows the same gown from the back.

FIG. 1 shows a piece of material 1 for a gown which is shown in FIGS. 4 and 5 and which is hereinafter called the gown 2. The gown is intended to be used as protective clothing for surgical operations and is primarily intended to be designed as a one-use garment and of a non-woven material such as non-woven fibre fabric. This does not however mean that a piece of material of the same type as the piece of material 1 cannot be used also for other types of garments, as will be indicated in greater detail in connection with the description of FIG. 6.

The piece of material 1 has a first straight edge 3, which delimits the lowest section of the gown and is hereinafter called the lower edge.

Opposite the lower edge 3 there extends an edge with two straight parts 4 and 5 angled off from each other which, in the direction of the lower edge 3, lead to two outer edges 6 and 7 which are at right angles to the lower edge 3. The edge 4, 5 is hereinafter called the transverse edge. The outer edges 6 and 7 are finished, in the direction of the lower edge 3, by cuts, hereinafter called arm cuts 8 and 9. Their inner ends are at a distance from each other which corresponds approximately to the size across the chest between the armpits for the body size for which the piece of material is intended. Between the arm cuts 8 and 9 and the lower edge 3 there extend straight edges hereinafter called the back edges 10 and 11. The back edges 10 and 11 run parallel to an extension of the outer edges 6 and 7 inside the latter, and the outer edges 6 and 7 constitute the greatest lateral extension of the piece of material. The material web from which the piece of material is to be cut out is therefore probably to be cut in a first cut along the edges 6 and 7 and their extensions, thus forming two areas 12 between the cut-lines of the latter and the edges 10, 11 which lines are indicated by broken lines. The side edges of the piece of material are thus formed by the edges 6 and 10 and 7 and 11 respectively.

The piece of material is identical on both sides and is thus symmetrical along a centre axis 16, which divides the lower edge 3 in half and runs inwards between the transverse edge parts 4 and 5 where they form a point. On this centre axis, which is indicated by a broken line, there is a neck opening 13 which is formed by a tear-like cut-line 14 and is finished with a cut 15 out towards the transverse edge 4, 5.

Important conditions in the piece of material are that the arm cuts 8 and 9 are at an oblique angle down towards the lower edge 3 measured from the centre axis 16. The transverse edge parts 4 and 5 are more oblique in the same direction. They meet on the centre axis at the said point. The angle for the arm cuts is thus greater (measured towards the centre axis on the underside towards the lower edge 3) than the corresponding angle for the transverse edge parts 4 and 5. The section which is formed between the arm cuts 8/9, the edges 6/7 and the transverse edge parts 4/5 therefore widens from the side edges 6/7 and in towards the finish of the arm cuts 8/9. Differences in the angles also mean that the length of the arm cuts including their extension out to the centre axis 16 is shorter than the corresponding end edge part 4/5. In the figure the said angle is approximately 75° for the arm cuts 8/9 and approximately 60° for the end edge parts 4, 5.

Figure 2:
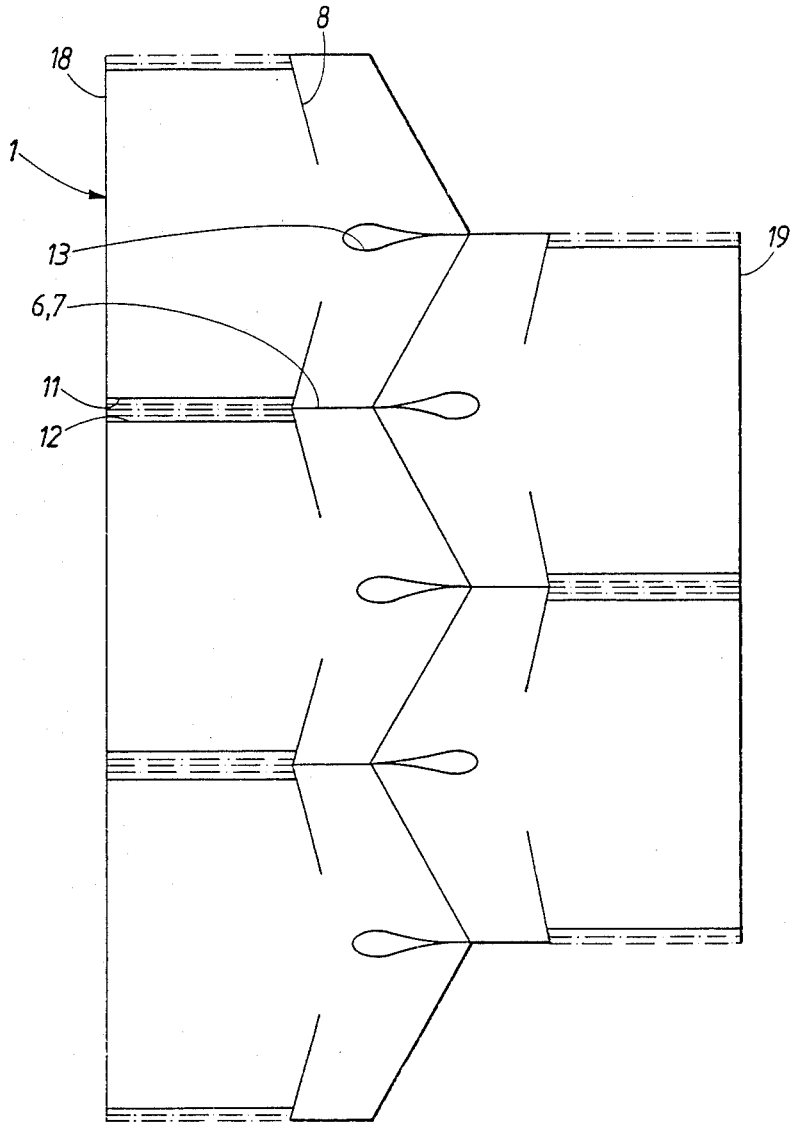
FIG. 2 shows a cutting scheme for positioning the piece of material on a material web.

FIG. 2 shows how a number of pieces of material 1 can be cut out of a material web the longitudinal edges of which are designated 18 and 19. As can be seen, the lower edges 3 of the piece of material are located at longitudinal edges 18 and 19, wherein one row of pieces of material projects inwards from one edge and one row in the converse position projects inwards from the second longitudinal edge. The outer edges 6 and 7 of the piece of material are formed by cut-lines which extend from respective longitudinal edges and in towards the neck opening 13 of the opposite piece of material. The two rows of pieces of material are separated from each other by a zigzag line which forms the transverse edge parts 4 and 5. In addition to the said cuts, only one cut is required to form the arm cuts 8 and 9 and to form the back edges 10 and 11, the areas 12 being left over from the web. As will be shown later, the areas 12 can be used as supplementary parts.

Figure 3:
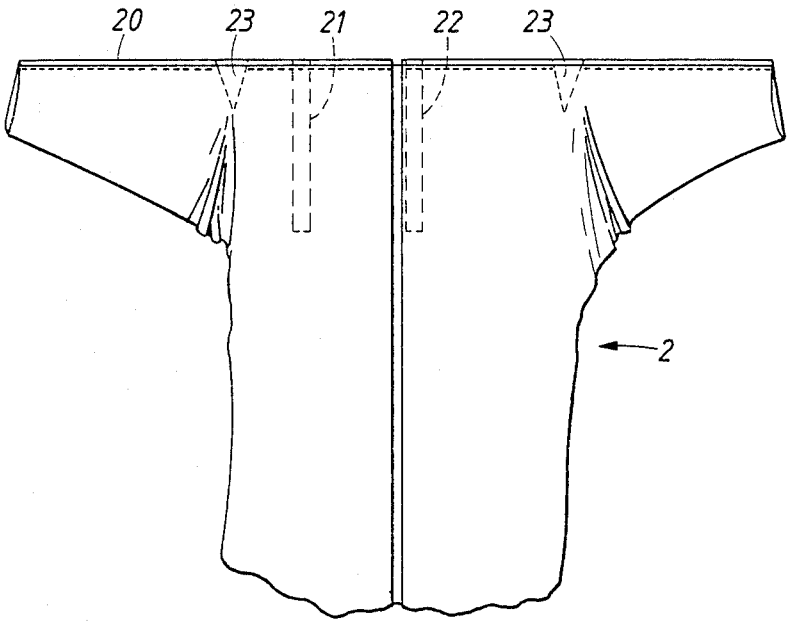
FIG. 3 shows a sewing scheme.

FIG. 3 shows how the piece of material 1 is sewn together. Only one seam needs to me made. The sections inside the back edges 10 and 11 are first folded in so that they meet at the centre axis. Thereafter half of the part which is located between the arm cuts 8/9 and the transverse edge parts 4/5 is folded down so that the outer sections of the end edge parts 4/5 meet the upper edges of the arm cuts 8/9 while the inner sections of the end edge parts meet the lower edges of the arm cuts, which, on the first-mentioned folding-in, are thus positioned in the centre of the piece of material. In order for the seam to be made, the central section of the piece of material between the inner edges of the arm cuts must be moved aside so that the sections inside the back edges 10 and 11 are not sewn onto the central section which is to form the front of the garment. This has been effected according to FIG. 3 by the piece of material being turned back in such a way that the said edges which meet each other form an outer edge on the piece of material folded together, which makes it easier to sew. Now a seam, designated 20, only has to be sewn along the said edge thus forming both the arms and the seam directly below shoulder-blade height between that part of the back of the garment which is formed by the sections inside the back edges 10 and 11 and the upper part of the back which is formed by the central sections below the transverse edge parts 4, 5. If a tie-knot is desired on the garment, the divided-up pieces of the sections 12 can be placed in the seam, and such a tie-knot has been designated 21 and 22 in FIG. 3.

FIG. 3 shows that the garment is turned inside out during sewing, which is common when it is desired to have the free material edges on the reverse of the garment. Thus the tie-knots 21, 22 lie inside the garment.

As was previously mentioned, each end edge part 4, 5 is longer than the corresponding arm cut 8, 9 together with its extension in towards the centre axis 16. This greater length is taken up by virtue of the fact that, on the back of the garment, the section inside the end edge is folded to form a fold 23 on each side, a fold which is to be positioned on a level with the finish of the respective arm cut 8, 9. The fold is folded and sewn firmly to the seam 20.

The fold 23 is required to be open in towards the centre, a condition which is reversed in the case of a garment turned the right way round (in FIG. 3 the fold is hidden by the overlying front of the garment and is thus shown with broken lines).

When the seam 20 has been made and the threads in the middle where the back edges 10 and 11 meet have been cut off, the garment is ready provided that it has been made of a non-woven material which does not have to be hemmed, and provided that it is not desired to sew on any additional fitting to the garment.

FIG. 4 shows a front view of the gown prepared in this way. As can be seen the front is completely undivided. The edge 3 forms the lower edge of the garment. The arm seam extends from the top side of the arm opening and around the arm to the lower edge of the same where it becomes the transverse seam which, immediately below shoulder-blade height, joins the upper and lower sections of the back as shown in FIG. 5. At the wrists, which are formed by the edges 6, 7, the gown shown is provided with arm wristlets 25, which is common in the case of surgeons' gowns and which requires a special fixing operation. If it is desired that the gown should have a belt, this can be prepared from the parts 12, which, as mentioned, are used for preparing the tie-knots 21 and 22, as shown also in FIG. 5.

By virtue of the tear shape of the neck opening 13, the neckband protects the neck at the front but at the same time provides high mobility since it does not fit tight at the back. However, it is also possible to make other types of neck openings, even those with a stiff collar, which is preferred in certain cases.

FIG. 5 also shows the fold 23. It constitutes, together with the direction of the arm seam, an important detail for the fit and usability of the garment. As mentioned, the positioning of the arm seam on the top side of the arm is advantageous for work garments and especially for surgeons' gowns. The direction of the seam around the arm below the armpit gives a good fit for the arms and improves their mobility. The fold 23 gives extra space across the shoulder section, which facilitates forward movement of the arms and reduces stress on an exposed important point of the garment.

Figure 6:
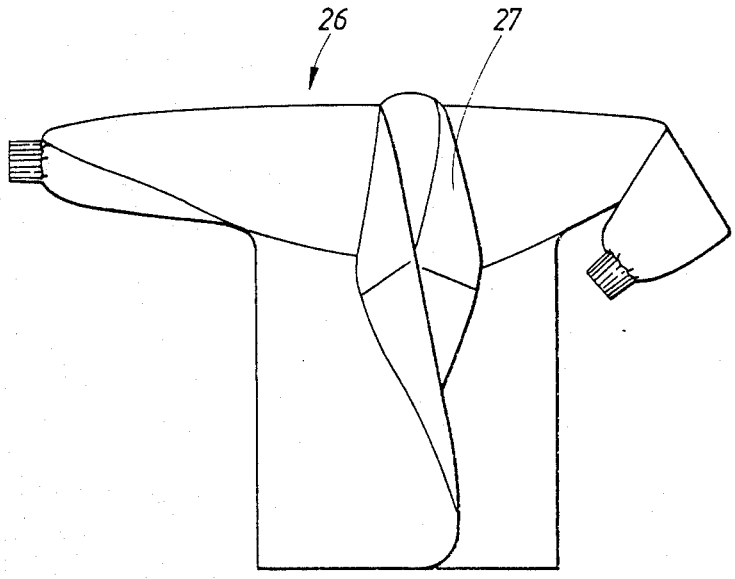
FIG. 6 shows, from the front, a gown with a closure at the front and intended to be of a more permanent type.

FIG. 6 shows a garment 26 of a more permanent type, for example a bathrobe or dressing-gown. The piece of material is essentially the same as that described previously. However, in this case the gown is intended to be used with the opening to the front and parts which were said to be back edges in the previously described gown have been folded down to form lapel 27.

This is only one additional example of how a piece of material according to the invention can be used for production of a garment. As mentioned at the outset, the piece of material can, by means of shortening, also be used for jackets or for the top parts of garments such as overalls. The size of the piece of material is, of course, to be determined according to standard sizes and desires in respect of arm length, gown length etc. It should be mentioned in this connection that the said factors, the forced armseam and the fold at the armpit make the garment highly adaptable to different body sizes so that the sizes in which the garment is produced do not have to be as close to each other in respect of dimensions. The said angles are also adapted to the use and design of the garment. The smaller the angle for the upper part of the piece of material is in relation to the angles of the arm cuts, the greater is the fold 23 and vice versa. For joining together in the case of certain materials sewing can be replaced by welding or glueing.

I claim:

1. Piece of material for an article of clothing (2) or part of such and produced from a thin, web-like material, which article of clothing or part is intended to cover at least the upper body of a wearer and thus to be provided with a front and a back which are finished with a lower edge, and, opposite this, a shoulder section with a neck opening (13) and, moreover, arms which are finished with wrists, wherein the piece of material comprises a first edge (3), which is intended to form the said lower edge, a second edge (4, 5) opposite this, two side edges (6, 10 and 7, 11) opposite each other which connect the two first-mentioned edges, and two cuts (8, 9) which extend inwards from the side edges and which are finished at a distance from each other which corresponds approximately to the size across the chest between the armpits for the body size for which the garment is intended, wherein the piece of material is essentially symmetrical about a centre axis (16) along which a neck opening (13) is to be located close to the second edge (4, 5), characterized in that the said cuts (8, 9) form an angle, to the centre axis (16), which, measured in the direction of the first edge (3), is less than 90°, and in that the second edge is divided into two parts (4, 5) each projecting from a side edge (6, 10 and 7, 11), which parts each have an angle, to the centre axis (16), which, measured in the direction of the first edge (3), is less than the corresponding angle for the cuts (8, 9).

2. Piece of material according to claim 1, characterized in that the two parts (4, 5) of the second edge meet in a point on the centre axis (16).

3. Piece of material according to claim 2, characterized in that the said angle to the centre axis (16) for the two cuts (8, 9) is approximately 75° and the angle for each of the two parts (4, 5) of the second edge is approximately 60°.

4. Piece of material according to any one of claim 1–3, characterized in that the said edges have a first part (6, 7) between the cuts (8, 9) in question and the second edge (4, 5) and a second part (10, 11) between the cut and the first edge (3), wherein the piece of material has a greater breadth over the first edge parts than over the second, so that the first edge parts form the greatest lateral extent of the piece of material, while the second edge parts are cut in in relation to the latter.

5. Use of the piece of material according to any one of claims 1–3 for production of an article of clothing (2) or part of such, which article of clothing or part is intended to cover at least the upper body of a wearer and thus to be provided with a front and a back which are finished with a lower edge and, opposite this, a shoulder section with a neck opening (13) and, moreover, arms which are finished with wrists, wherein the piece of material (1) is produced from a thin, web-like material and comprises a first edge (3) which is intended to form the said lower edge, a second edge (4, 5) opposite this, two side edges (6, 10 and 7, 11) opposite each other which connect the two first-mentioned edges, and two cuts (8, 9) which extend in from the side edges and which are finished at a distance from each other which corresponds approximately to the size across the chest between the armpits for the body size for which the garment is intended, wherein the piece of material is essentially symmetrical about a centre axis (16) along which a neck opening (13) is to be located close to the second edge (4, 5), with the said cuts (8, 9) forming an angle, to the centre axis (16), which, measured in the direction of the first edge (3), is less than 90° and with the second edge divided into two parts (4, 5) each projecting from a side edge (6, 10 and 7, 11), which parts each have an angle, to the centre axis (16), which, measured in the direction of the first edge (3), is less than the corresponding angle for the cuts (8, 9), characterized in that the piece of material (1) is joined together with the outer sections of the second edge (4, 5) joined to that edge of the respective cut (8, 9) directed towards the said second edge, and the inner sections of the second edges (4, 5) joined to those edges of the cuts which are turned towards the first edge, wherein the section nearest the second edge (4, 5) is folded over the section nearest the cuts (8, 9) and over the central part of the piece of material lying therein, with the outer sections of the second edge meeting the said cut-edges and the sections between the cuts (8, 9) and the first edge (3) folded in towards each other to meet, by means of their edges formed by the cut, the inner, central section of the second edge (4, 5).

6. Use according to claim 5, wherein use is made of the piece of material according to claim 2, characterized in that, on joining together, a fold (23) is made in the material in that section which connects with the second edge (4, 5) approximately on a level with the inner finish of each cut (8, 9), and with the fold being of such a size that the edges joined together, despite their length being different due to the said different angles, follow each other with the material essentially smooth outside the fold.

7. Use according to claim 6, characterized in that, on joining together, a fastening device for the garment, such as a tie-knot (21, 22), is fixed in the same operation.

* * * * *